US006176483B1

(12) United States Patent
Malevanchik

(10) Patent No.: US 6,176,483 B1
(45) Date of Patent: Jan. 23, 2001

(54) HIGH SPEED DOCUMENT SEPARATOR AND SEQUENCING APPARATUS

(75) Inventor: Leonid Malevanchik, Tucson, AZ (US)

(73) Assignee: Bell & Howell Mail and Messaging Technologies Company, Durham, NC (US)

( * ) Notice: Under 35 U.S.C. 154(b), the term of this patent shall be extended for 0 days.

(21) Appl. No.: 08/816,193

(22) Filed: Mar. 12, 1997

(51) Int. Cl.[7] ..... B65H 5/34; B65H 29/68

(52) U.S. Cl. ..... 271/270; 271/266; 271/121; 271/182

(58) Field of Search ..... 271/182, 186, 271/121, 266, 270, 272

(56) References Cited

U.S. PATENT DOCUMENTS

| | | | | |
|---|---|---|---|---|
| Re. 24,459 | | 4/1958 | Kern . | |
| 1,543,842 | | 6/1925 | Gwinn et al. . | |
| 1,668,761 | | 5/1928 | Coty et al. . | |
| 2,155,895 | | 4/1939 | Gibson, Jr. . | |
| 2,815,946 | | 12/1957 | Cran . | |
| 2,861,801 | | 11/1958 | Cran . | |
| 2,877,885 | | 3/1959 | Wheeler, Jr. . | |
| 2,915,863 | | 12/1959 | Kummer . | |
| 3,000,151 | | 9/1961 | Winkler et al. . | |
| 3,199,688 | | 8/1965 | Levy . | |
| 3,253,384 | | 5/1966 | Huck et al. . | |
| 3,423,900 | | 1/1969 | Orainger . | |
| 3,517,919 | | 6/1970 | Flygare . | |
| 3,741,357 | * | 6/1973 | Krysuik et al. | 271/47 |
| 3,872,649 | | 3/1975 | Wimmer . | |
| 4,037,525 | | 7/1977 | Sjogren et al. . | |
| 4,039,180 | | 8/1977 | Stocker . | |
| 4,429,866 | * | 2/1984 | Castro-Hahn | 271/266 |
| 4,485,949 | * | 12/1984 | Gebhart et al. | 271/259 |
| 4,512,562 | | 4/1985 | Moll . | |
| 4,523,502 | | 6/1985 | Besemann . | |
| 4,538,511 | | 9/1985 | Wise . | |
| 4,568,074 | * | 2/1986 | Murayoshi | 271/119 |
| 4,649,691 | | 3/1987 | Buckholz . | |
| 4,723,883 | | 2/1988 | Smith . | |
| 4,772,003 | | 9/1988 | Nobuta et al. . | |
| 4,772,004 | | 9/1988 | Golicz . | |
| 4,844,435 | | 7/1989 | Gianetti et al. . | |
| 4,875,668 | | 10/1989 | Spyra . | |
| 4,879,862 | | 11/1989 | Nolte et al. . | |
| 4,896,876 | * | 1/1990 | Yamada et al. | 271/265.02 |
| 4,909,499 | | 3/1990 | O'Brien et al. . | |
| 4,993,916 | | 2/1991 | Dorner . | |
| 4,997,337 | | 3/1991 | Trimble . | |
| 5,033,729 | | 7/1991 | Struthers . | |
| 5,044,876 | | 9/1991 | Stohlquist . | |
| 5,095,684 | | 3/1992 | Walker et al. . | |
| 5,117,614 | | 6/1992 | Johnson . | |
| 5,251,425 | | 10/1993 | Kern . | |
| 5,439,208 | * | 8/1995 | Moser et al. | 271/225 |
| 5,810,173 | * | 9/1998 | Stevens et al. | 271/229 |

FOREIGN PATENT DOCUMENTS

| | | |
|---|---|---|
| 2913428 | 10/1880 | (DE) . |
| 2420078 | 11/1975 | (DE) . |
| 1145654 | 10/1957 | (FR) . |

* cited by examiner

*Primary Examiner*—Donald P. Walsh
*Assistant Examiner*—Daniel K. Schlak
(74) *Attorney, Agent, or Firm*—Patula & Associates P.C.

(57) ABSTRACT

A separator and sequencing apparatus comprising a first selective document transport means for selective movement of documents and a second selective document transport means for selective movement of documents positioned adjacent to the first selective document transport means, the first and second selective document transport means configured to move at least one of a pair of documents located in said separator and sequencing apparatus.

13 Claims, 4 Drawing Sheets

HIGH SPEED DOCUMENT SEPARATOR AND SEQUENCING APPARATUS

BACKGROUND OF THE INVENTION

1. Field of the Invention

The instant invention relates generally to an apparatus for separating and sequencing documents for use with document handling machines and the like.

The instant invention provides an apparatus comprising two spaced document handling apparatus configured to be positioned along a document line of travel. Each document handling apparatus may be separately controlled such that overlapping documents traveling into the instant separator and sequencing apparatus may be separated when so required by advancing a first document with respect to a second document. Furthermore, the present separator and sequencing apparatus may serve as a buffer by temporarily detaining documents to allow, for example, separation of documents into predetermined account groups.

2. Description of the Related Art

Prior systems employed for printing and gathering documents have comprised a printer for printing a pair of documents side by side and a cutter to separate the pair of documents from the roll of paper at the printer and one from the other. Such prior systems further comprised an inverter to align the documents into a single path orientation rather than the side by side orientation dictated by the printer. The documents could be forwarded to an assembly for gathering a stack of documents.

Prior systems have recognized that it may be desirable to advance each document of the pair of documents separately to the assembly for gathering a stack of documents. Separate advancement has traditionally been accomplished in two manners. In the first manner, the advancement of one document of each pair of documents printed by the printer is retarded at the cutter while the advancement of the other document is allowed to advance freely. In the second manner, the inverter either retards the advancement of, or creates a longer path of travel for, one of the documents with respect to the other document. In either manner, the pair of documents exit the inverter without either document contacting the other.

It is worthy to note that prior manners of separating a pair of documents necessarily separate each and every pair of documents printed by the printer and advanced to the assembly for gathering documents. When a system for printing and gathering documents is employed to produce a plurality of different groups of documents called accounts, only pairs of documents which comprise a document from two different accounts need to be separated before being advanced to the assembly for gathering documents. Every other pair of documents printed by the printer may be advanced to the assembly for gathering documents without separating each of the documents in the pair of documents. Consequently, prior systems employed for printing and gathering groups of documents by accounts slow the process of printing and gathering documents by requiring unnecessary separation some documents. The larger the number of pages being processed in each account, the larger the number of pairs of documents in each account which need not be separated and the larger the resultant delay caused by the separation of each pair of documents.

Additionally, the prior manners of separating a pair of documents retarded one of the documents of the pair of documents a predetermined amount. The prior manners did not possess a manner of varying the retardation. Consequently, the assembly for gathering documents used in the prior manners of printing and gathering documents could not be given extra time to unload an account. Extra time may be necessary, for example, due to size of the account.

It is therefore an object of the present invention to provide an apparatus for separating documents which may selectively separate pairs of documents.

It is a further object of the present invention to provide an apparatus for separating documents which is efficient.

It is a further object of the present invention to provide an apparatus for separating documents which may provide a buffer to the assembly for gathering documents.

It is a further object of the present invention to provide an efficient apparatus for sorting documents by account.

It is a further object of the present invention to provide an efficient apparatus for sorting documents which apparatus may be integrated into prior assemblies for printing and sorting documents.

SUMMARY OF THE INVENTION

The above and other objects of the present invention are accomplished by providing a separator and sequencing apparatus comprising two distinct document handling apparatus each of which preferably comprise a pair of rollers between which each document traveling along a document line of travel will pass. Each pair of rollers has two horizontally extending rollers mounted one above the other such that the rollers may contact and control the documents traveling therebetween to allow selective acceleration, deceleration, starting or stopping of said documents by said pair of rollers.

Separating and sequencing of documents traveling through the separator and sequencing apparatus is facilitated by spacing the distinct pairs of rollers and providing separate acceleration and deceleration to each. The ability to control the speed of one pair of rollers relative to the other allows relative movement of a document grasped in one pair of rollers with respect to a document grasped in the other pair of rollers. Consequently, documents which enter the separator and sequencing apparatus of the present invention in a partially overlapping relation may be separated one from the other by movement of one document relative to the other. Additionally, the selective control afforded each pairs of rollers of the present separator and sequencing apparatus allows the present separator and sequencing apparatus to provide a buffer in the supply of documents traveling along the document line of travel. Consequently, each document of a pair of documents within the present separator and sequencing apparatus may be forwarded to a separate predetermined account group. Importantly, however, the present separator and sequencing apparatus may advance a pair of overlapping documents therein without separating said pair of documents. Consequently, the present separating and sequencing apparatus affords the ability to separate only documents belonging to separate accounts while merely advancing documents belonging to the same account. The overall processing rate of an apparatus employing the present separating and sequencing apparatus may thereby be increased.

The present separator and sequencing apparatus is preferably placed in a document handling machine comprising an automated control system comprising sensors and means of controlling the separator and sequencing apparatus to provide smooth and efficient operation of the document handling machine. In a preferred embodiment, the automated control system comprises a sensor capable of determining the account association of each document passing thereby. In this manner, the automated document handling system may possess information as to whether each document in the present separating and sequencing apparatus belongs to the same or different accounts.

Numerous other advantages and features of the invention will become readily apparent from the detailed description of the preferred embodiment of the invention, from the claims, and from the accompanying drawings, in which like numerals are employed to designate like parts throughout the same.

BRIEF DESCRIPTION OF THE DRAWINGS

A fuller understanding of the foregoing may be had by reference to the accompanying drawings, wherein.

DETAILED DESCRIPTION OF THE PREFERRED EMBODIMENT

Figure 1:
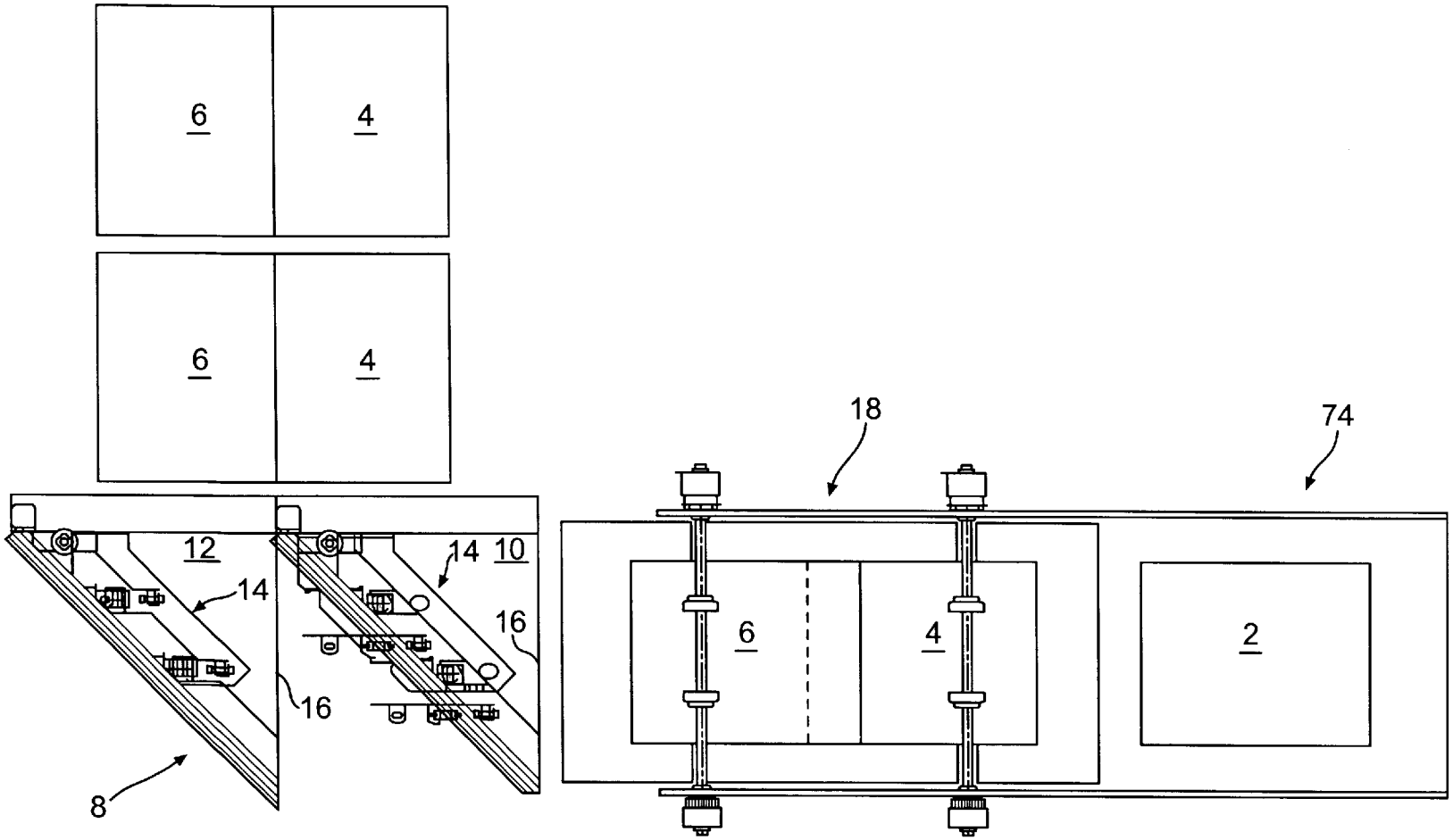
FIG. 1 depicts a substantially schematic representation of documents proceeding through a preferred application of the present separator and sequencing apparatus.

While the invention is susceptible of embodiment in many different forms there is shown in the drawings and will be described herein in detail, a preferred embodiment of the invention. It should be understood, however, that the present disclosure is to be considered an exemplification of the principles of the invention and is not intended to limit the spirit and scope of the invention and/or claims of the embodiment illustrated.

The separator and sequencing apparatus 18 of the present invention may be employed in any application desiring to separate a pair of overlapping or non-overlapping documents. However, by way of example only, the present separator and sequencing apparatus 18 will be herein described in an environment designed for high speed printing and sorting of documents. Other applications of the present invention will become apparent from the description presented herein. That environment, partially depicted in FIG. 1 comprises a document printer (not depicted), a document cutter (not depicted), a document inverter 8, the separator and sequencing apparatus 18 of the present invention, a document accumulator 74 and an automated control system 76, partially depicted in FIG. 6, to facilitate proper coordination between each element of the environment and the elements of the separator and sequencing apparatus 18.

The separator and sequencing apparatus 18 of the present invention is configured to handle documents, referred to generally as documents 2 and specifically as a first document 4 and a second document 6 when referring to a first and/or second document 4,6 of a pair of documents. As described herein, the documents fed to the separator and sequencing apparatus 18 are produced by a typical high speed printer (not depicted). To allow for quicker feeding of paper into the printer and lower costs of said paper, a typical high speed printer prints documents onto paper fed from a wide roll rather than sheets preformed to the document size. High speed printing of documents is usually accomplished by printing two documents simultaneously, across the width of the roll of paper. Described differently, the documents are printed in a side by side orientation as they would appear in a book. This configuration is called a two-up configuration and is represented in FIG. 1 by the documents entering the inverter 8. Consequently, the width of the roll is typically at least twice the width of each document 2. The cutter (not shown) is positioned adjacent to the printer and separates printed documents 2 from the roll of paper and also separates the first and second documents 4,6 one from the other in the two-up configuration. Each pair of separated documents 4,6 therefore enter the inverter 8 in the two-up configuration.

It is preferable that the separating and sequencing apparatus 18 of the present invention receive each document 2 in a portrait orientation as depicted in the figures. The portrait orientation comprises the shorter width entering the separator and sequencing apparatus 18 first as the document travels along its length. By orienting the documents 2 in the portrait orientation, the width of the separator and sequencing apparatus 18 only need accommodate the width of a single document rather than the length thereof. The benefits of the present separating and sequencing apparatus 18 are best experienced when the documents 2 enter the separating and sequencing apparatus trailing one behind the other as depicted in the figures. Again this reduces the width requirements for the separating and sequencing apparatus 18. Furthermore, the documents 2 entering the separating and sequencing apparatus 18 need only be manipulated forward and backward rather than from side to side as well in order to accumulate all documents 2 in a single accumulator 74 of documents consistent with the present invention.

The inverter 8 which is preferably employed with the present separator and sequencing apparatus 18 and depicted in FIG. 1 comprises a generally twisted C-shaped cylindrical deflector. The inverter 8 comprises a first shrouding 10 and a second shrouding 12 which provide the twisted C-shape of said inverter 8. The C-shape of the inverter 8 inverts each document 2 while the twisted form thereof simultaneously rotates each document 2 ninety degrees toward the separating and sequencing apparatus 18 as depicted in FIG. 1. That is, the first and second shrouding 10,12 curve upward and over so that documents 4,6 leaving the first and second shrouding 10,12 are inverted with the printed side of each document 4,6 entering the separating and sequencing apparatus 18 facing downward. Additionally, the first and second shrouding 10,12 each angle toward the separating and sequencing apparatus 18 to redirect each document 4,6 onto said separating and sequencing apparatus 18. Each document 4,6 exits the inverter 8 in a portrait orientation with the first document 4 overlapped and trailed by the second document 6 as a result of the inversion imparted by the inverter 8. Preferentially, a draw-off conveyor 14 is positioned at the exit 16 of each shrouding 10,12 to complete the procession of each document 2 through the inverter 8.

Accordingly, each pair of documents 4,6 leaving the inverter 8 and entering the separating and sequencing apparatus 18 are in portrait orientation with the second document 6 trailing and overlapping the first document 4. It should be recognized, however, that the present invention would be able to accommodate first and second documents 4,6 if the inverter 8 were to orient the second document 6 trailing the first document 4 and being overlapped by the first document 4.

In the environment herein presented, the separator and sequencing apparatus 18 is designed to deliver documents 2 from the inverter 8 into the accumulator 74. The accumulator 74 is designed to accumulate groups of documents 2, hereinafter referred to as accounts, and deliver each account for further processing. A typical example of an account is a billing statement to be enveloped and mailed. Usually, billing statements are multiple pages and the number of pages for any one account depends upon the number of billable transactions for the billing cycle being billed. Therefore, the number of documents in any single account may vary. Once accumulated, the account may be delivered to any apparatus which can make use of the accumulated groups of documents. For example, the account could be delivered to an envelope packing apparatus (not shown), such as that of co-pending U.S. patent application Ser. No. 08/734,632 assigned to the assignee of the present invention. However, because the number of documents 2 making up each account varies, any pair of documents 4,6 exiting the cutter in the two-up position could comprise either two documents from the same account or one document from each of two distinct accounts. Consequently, when two documents 4,6 from distinct accounts exit the inverter 8, those two documents 4,6 are overlapping and need to be separated and placed with their associated accounts. Two documents 4,6 from the same account, however, may simply be advanced to the accumulator 74 without the delay required for separating said documents 4,6.

Figure 4:
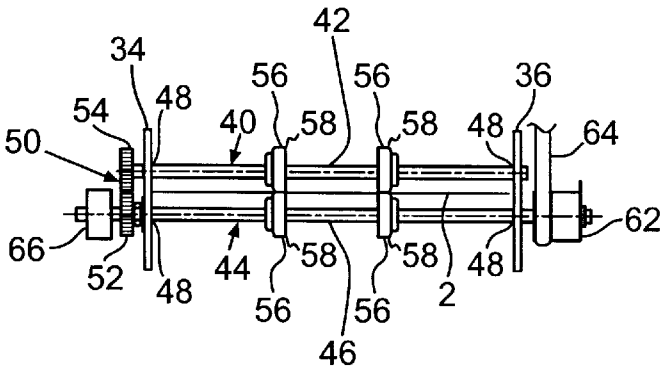
FIG. 4 depicts a substantially schematic cross-sectional representation of a front view of the present separator and sequencing apparatus taken along line IV—IV of FIG. 2.
Figure 2:
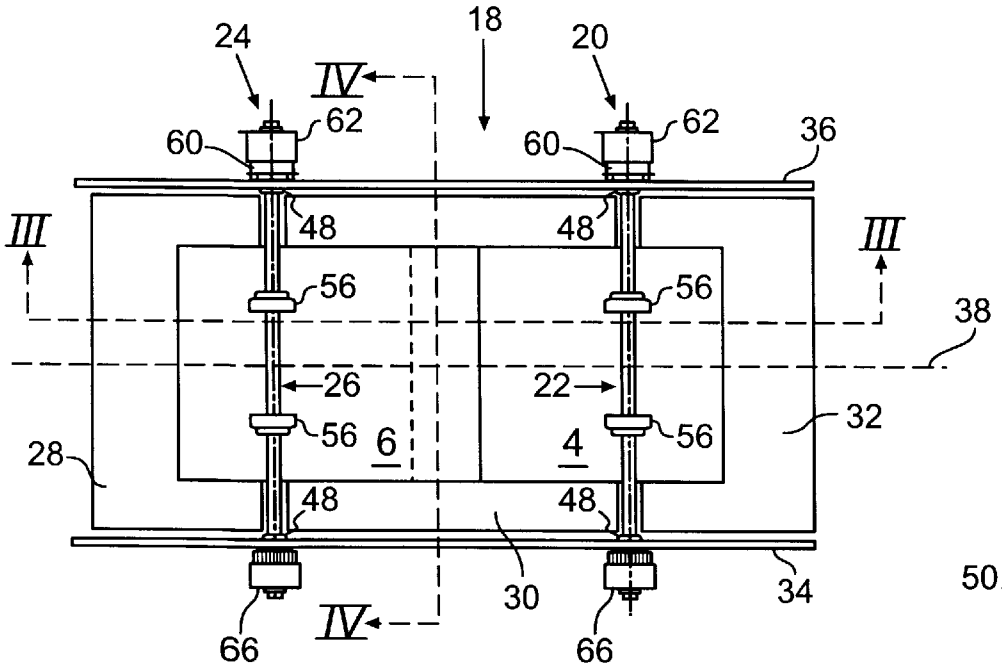
FIG. 2 depicts a substantially schematic representation of a top view of the present separator and sequencing apparatus.
Figure 3:
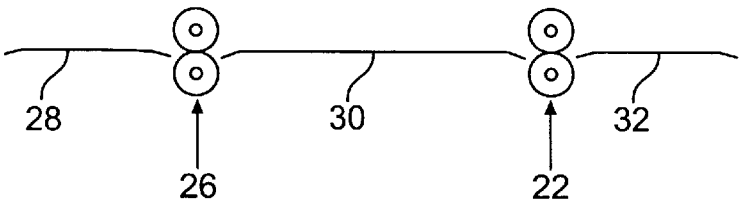
FIG. 3 depicts a substantially schematic cross-sectional representation of a side view of the present separator and sequencing apparatus taken along line III—III of FIG. 2.

The present separator and sequencing apparatus 18 depicted in FIGS. 1–4 accomplishes the separation of each pair of documents 4,6 and facilitates depositing each document 4,6 in their associated account. As depicted in FIGS. 2 and 4, the separator and sequencing apparatus 18 comprises a first selective document transport means 20, preferably comprised of a first pair of rollers 22 and a second selective document transport means 24, preferably comprised of a second pair of rollers 26. While the preferred embodiment of the first and second selective document transport means 20,24 are represented by said first and second pair of rollers 22,26, other embodiments are contemplated as will be hereinbelow described. Preferably a first guide 28 is positioned adjacent to the second pair of rollers 26 to guide each document 2 entering the separator and sequencing apparatus 18 into proper alignment with the second pair of rollers 26. The first and second pair of rollers preferably have a second guide 30 positioned therebetween to guide each document 2 from the second pair of rollers 26 into proper alignment with the first pair of rollers 22. A third guide 32 is preferably positioned adjacent to the first pair of rollers 22 opposite of the second guide 30 to guide each outgoing document 2 to the accumulator 74 or other apparatus depending upon the environment of the present apparatus 18. The positioning of first, second and third guides 28,30,32 as described above and depicted in FIGS. 2 and 3 allow transport of documents 2 through the present separator and sequencing apparatus 18.

Each of the first and second pair of rollers 22,26 are mounted between a frame assembly first portion 34 and a frame assembly second portion 36. The frame assembly portions 34,36 are preferably oriented substantially parallel to one another and at a distance from one another to allow the width of the largest anticipated document 2 to pass therebetween. A document path of travel 38 is therefore provided between the first and second frame assembly portions. The first and second pair of rollers 22,26 are mounted to each of the first and second frame portions 34,36 and extend substantially perpendicular to the first and second frame assembly portions 34,36. It is preferred that at least one of said first and second pair of rollers 22,26 is selectively mounted along the frame assembly first and second portions 34,36 so that said at least one pair of rollers 22,26 may be adjusted to accommodate any length document which is desired to be employed in the present apparatus. The first, second and third guides 28,30,32 are also preferably adjustably mounted to the frame assembly first and second portions 34,36 to allow proper alignment adjacent the first and second pair of rollers 22,26. Adjustment of the pairs of rollers 22,26 may be desired or necessitated to separate and sequence varying lengths of documents. Adjustment of the at least one pair of rollers 22,26 may also be desired due to variations in the configuration of the inverter 8 employed because such variations may cause different overlaps of the first and second documents 4,6.

Figure 5A:
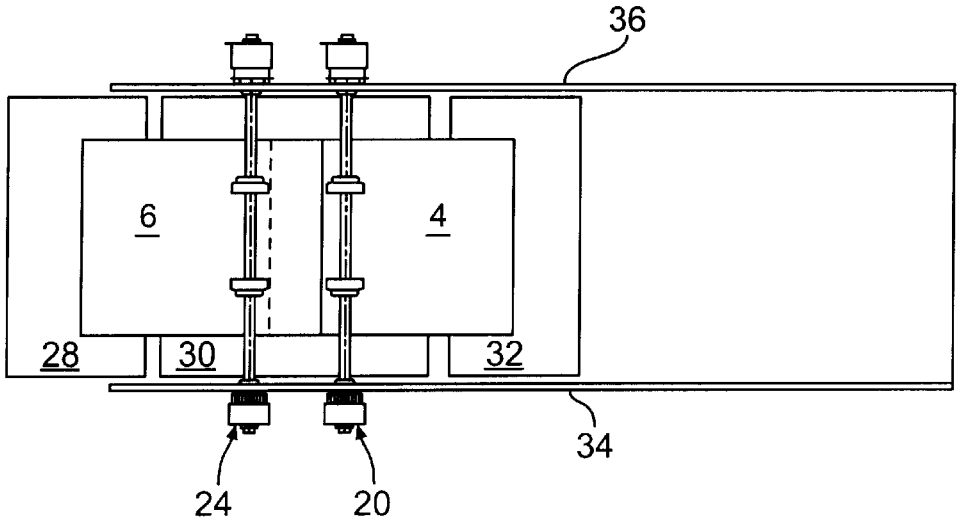
FIG. 5A depicts a substantially schematic representation of a top view of the present separator and sequencing apparatus with the document handling apparatus separated a minimum distance.
Figure 5B:
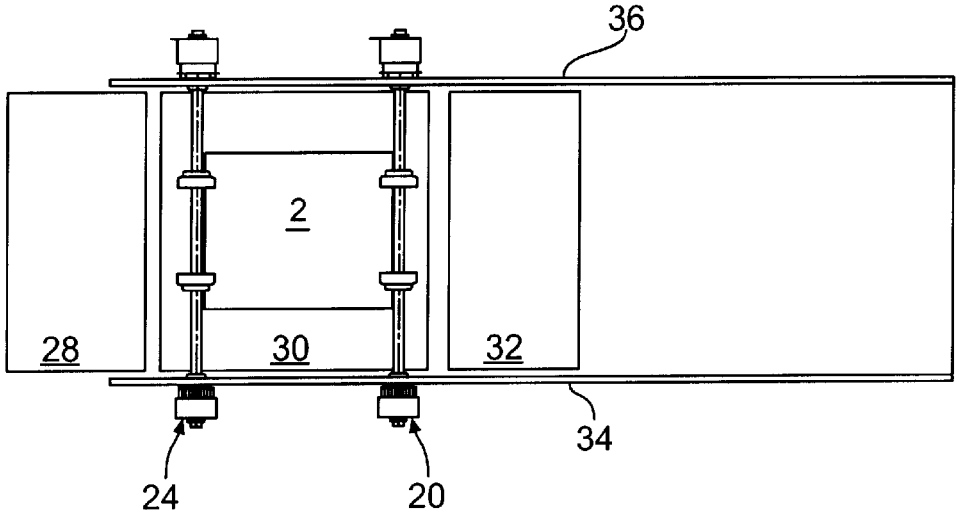
FIG. 5B depicts a substantially schematic representation of a top view of the present separator and sequencing apparatus with the document handling apparatus separated a maximum distance.

It is preferred that the first and second document transport means 20,24 are positioned at least a distance from one another equal to the overlap area of the second document 6 onto the first document 4 caused by the inverter 8 as depicted in FIG. 5A. Said distance insures that the overlapping area is not grasped by each of the first and second document transport means 20,24 which would inhibit separation of the first and second documents 4,6 with the present apparatus 18. Additionally, said distance between said first and second document transport means 20,24 is preferably not greater than the length of each document 2 which are intended to be run through the separating and sequencing apparatus 18 as depicted in FIG. 5B. Said distance insures that a document will not be left out of the grasp of both of the first and second document transport means 20,24 until desired.

The first pair of rollers 22 and the second pair of rollers 26 are preferably of identical configurations to limit variations in parts and thereby lower production and repair costs. However, it is contemplated that varying and/or differing designs could be employed for the first pair of rollers 22 with respect to the second pair of rollers 26.

As depicted in FIG. 4, each pair of rollers 22,26 comprises an upper roller assembly 40 comprising a shaft 42 and a lower roller assembly 44 comprising a shaft 46. The shaft 42, 46 of each of said upper and lower roller assemblies 40,44 are selectively mounted to extend between the frame assembly first portion 34 and the frame assembly second portion 36 with bearing means 48 positioned between each shaft 42, 46 and each frame assembly first and second portion 34,36. All known bearing means are contemplated to allow for substantially free rotation of the shafts 42,46 with respect to the frame assembly first and second portions 34,36.

Each lower roller assembly 44 is preferably connected to the upper roller assembly 40 by an engagement means 50 to provide synchronous rotation of the upper and lower roller assemblies 40,44. Preferably the engagement means 50 is comprised of a lower spur gear 52 and an upper spur gear 54 mounted on the lower and upper shafts 46,42 respectively as depicted in FIG. 4. It is preferred that the engagement means 50 is positioned at a point on the upper and lower roller assemblies 40,44 which is outside of the frame assembly first or second portion 34, 36. This positioning prevents the engagement means 50 from interfering with any documents traveling along the path of document travel 38.

The preferred lower and upper spur gears 52,54 are configured of a diameter such that the teeth of each lower spur gear 52 mesh with the teeth of the corresponding upper spur gear 54. In this manner, rotational force need only be imparted to one of the upper or lower spur gears 52,54 to accomplish rotation of both the upper and lower shafts 46,42.

Each of the lower and upper roller assemblies 44,40 preferably comprise at least one roller wheel 56 mounted thereon at a position between the first and second frame assembly portions 34,36 such that each said at least one roller wheel 56 lies in the path of document travel 38 to afford the lower and upper roller assemblies 44,40 control over documents 2 passing along the path of document travel 38. Each roller wheel 56 on the lower roller assembly 44 is positioned on said lower shaft 46 so that an outer circumference 58 of said roller wheel 56 is immediately adjacent to the outer circumference 58 of the roller wheel 56 of the upper roller assembly 40. The outer circumference 58 of the roller wheels 56 mounted on the lower and upper roller assemblies 44,40 should be separated enough to allow documents 2 to fit between said outer circumferences 58, yet facilitate enough friction between the roller wheels 56 and the documents 2 to provide the roller wheels 56 control over the documents 2 movement.

Although varying numbers of roller wheels 56 are contemplated, each of the upper and lower roller assemblies 40,44 preferably have at least two roller wheels 56 mounted thereon as shown in FIGS. 2 and 4 to provide at least two points of contact for each document 2. Employing two points of contact at each roller assembly 40,44 provides orientational stability to each document 2 with respect to the document traveling along the document path of travel 38. In this manner, the two points of contact prevent misdirection resulting from rotation about the single point of contact provided by single roller wheels 56.

The outer circumference 58 of each roller wheel 56 is preferably comprised of a material which provides sufficient friction between each roller wheel 56 and the documents 2 intended to pass through the separator and sequencing apparatus 18 to allow control of said documents 2 movement. Furthermore, the outer circumference 58 of each roller wheel 56 may comprise a pattern of nubs or other configuration configured to provide for the optimum frictional contact between the roller wheel 56 and the documents 2 intended to travel through the separator and sequencing apparatus 18. All materials and/or configurations known in the art for providing appropriate frictional contact between a roller and a document 2 are contemplated at the outer circumference 58 of each roller 56.

Alternatively, said roller shafts 46,42 may themselves provide contact with the documents passing therebetween in the absence of roller wheels 56. In this configuration, the roller shafts 46,42 would comprise a friction inducing outer material such as those described above for the roller wheels 56. The roller shafts 46,42 would be positioned to separate the outer circumferences thereof enough to allow documents 2 to pass therebetween, but facilitate enough friction between the roller shafts 46,42 and the documents 2 to provide the roller shafts 46,42 with control over the documents 2.

The foregoing descriptions should make evident that the speed of rotation of the lower and upper roller assemblies 44,40 will dictate the linear speed of documents 2 located therebetween along the document path of travel 38. It should also be evident that a first and second document 4,6 positioned in the separating and sequencing apparatus 18 such that the first document 4 is located within the first pair of rollers 22 and the second document 6 is located within the second pair of rollers 26, will facilitate individual control over each of the first and second documents 4,6 by the first and second pair of rollers 22,26 respectively. Affording the first and second pair of roller 22,26 with individual control will thereby provide the present separating and sequencing apparatus the ability to separate a first document 4 from a second document 6 overlapping said first document 4.

By configuring the diameter of each spur gear 52,54 to be of a diameter equal to that of the roller wheels 56 mounted on the corresponding shaft 46,42, the speed of angular rotation of the roller wheels 56 of the upper and lower roller assemblies 40,44 will be equal as experienced by any document 2 traveling therebetween. Slippage between any roller wheel 56 and the documents 2 traveling therebetween is therefore prevented. Preventing slippage is important to ensure that freshly printed documents are not distorted and that the ink thereon is not smeared. While the configuration above is preferred it should be noted that any diameter roller wheel 50 and any engagement means 50 are contemplated so long as each document 2 experiences a substantially equal speed of rotation from the roller wheels 56 mounted on the upper and lower roller assemblies 40,44.

A coupling means 60 is fixed to one of said upper roller shaft 42 and lower roller shaft 46. FIG. 4 depicts said coupling means fixed to lower roller shaft 46. As with the spur gears 52,54 it is preferred that the coupling means 60 is positioned outside of the frame assembly such that the coupling means 60 is not in the document line of travel 38. In this manner, the coupling means 60 will not interfere with documents 2 traveling through the separating and sequencing apparatus 18. Although the coupling means 60 is depicted as mounted to the lower roller shaft 46 and outside the frame assembly second portion 36, it is contemplated that the coupling means 60 may be fixed to the upper roller shaft 42 and that the coupling means 60 may be mounted outside the frame assembly first portion 34 without detracting from the scope of the present invention.

Any means of supplying or directing rotation to the rollers is contemplated as supplying coupling means 60. However, it is preferred that coupling means 60 comprise a timing belt pulley, as depicted in FIGS. 2 and 4. Employing a timing belt pulley allows elimination of slippage at the coupling means 60. Therefore, no rotation intended to be imparted to the documents 2 is lost at the coupling means 60. Elimination of lost rotation is important because of the precise positioning required of each document 2 to ensure proper placement of each document 2 into the appropriate account in the accumulator 74.

A clutch means 62 is preferably fixed between each coupling means 60 and one of said upper or lower roller shafts 42,46 to allow selective driving of the upper and lower roller shafts 42,46. While said clutch means 62 may be attached to either the upper or the lower roller shafts 42,46, depending upon the positioning of the coupling means 60, said clutch means is depicted in FIG. 4 adjacent to said coupling means 60 consistent with the preferred invention. The clutch means 62 may be any of the clutch configurations known in the art. It is preferred, however, that the coupling means 60 comprise electromagnetic control to facilitate optimum operation with said automated control system.

A drive means 64 is associated with each coupling means 60 to impart rotational force thereto. Employing the clutch means 62 at each lower roller shaft 46 allows individual control of drive imparted to each lower roller shaft 46 by said drive means 64 even where continuous rotation is provided by said drive means 64 to drive both coupling means 60. Such individual control may be accomplished by employing selective, individual control of each clutch means 62. The drive means 64 preferably comprises a timing belt driven by an external rotational source to provide a proper non-slipping connection between the drive means 64 and the preferred timing belt of the coupling means 60. The use of clutch means 62 also allows for control of the relative speed of each pair of rollers 22,26 with respect to the other. This may be accomplished by varying the engagement of each clutch means 62. By inducing slippage at the clutch means 62 of either the first or second pair of rollers 22,26 rotational force imparted to either the first and/or second pair of rollers 22,26 may be reduced.

However, it is contemplated that each individual coupling means 60 could be driven by a separate drive means 64. In such a configuration, the clutch means 62 at each pair of rollers 22,26 may be eliminated and selective rotation of the pairs of rollers 22,26 could be accomplished by selective operation of the respective external drive means 64. Although the preferred configurations have been described in detail, any combination of drive means 64 and/or clutch means 62 which may produce the start-stop drive required by the present separating and sequencing apparatus 18 is contemplated.

A brake means 66 is preferably employed at each of the first and second pair of rollers 22,26 to selectively stop or slow rotation of each of the upper and lower roller assemblies 40,44 as required for control of documents consistent with the requirements herein below described. It is contemplated that the brake means 66 could be placed anywhere on the respective pairs of rollers 22,26. However, the brake means 66 is depicted adjacent the lower spur gear 52 in FIG. 4. The use of a brake means 66 allows for separation and sequencing of documents at higher speeds. Higher speed operation is, in part, allowed by eliminating the time required for a pair of rollers 22,26 to stop rotating solely from friction rather than a controlled brake means 66. Operation without a brake means 66 would therefore increase the overall time required for each document 2 to reach the accumulator 74. All brakes known in the art are contemplated for brake means 66.

It should be noted that while the preferred embodiment of the present separator and sequencing apparatus 18 comprises the coupling means 60, the clutch means 62 and the drive means 64 all located adjacent the frame assembly second portion 36 and the spur gears 52,54 and the brake means 66 positioned adjacent the frame assembly first portion 34, alternate positions of these components are contemplated to accomplish selective rotation, slowing and stopping of the upper and lower roller assemblies 40,44. For example, placing the coupling means 60, the clutch means 62, the drive means 64 and the brake means 66 on the upper roller shaft 42 of each pair of rollers 22,26 could accomplish the objectives of the present separating and sequencing apparatus 18. Alternatively, any of these elements may be adjacent the frame assembly second portion 36 so long as the clutch means 62 and the coupling means 60 are configured to allow selective rotation of each of the first and second pair of rollers 22,26.

By allowing selective driving and braking of the first and second selective document transport means 20,24, each document 2 which is grasped by said selective document transport means 20,24 may selectively be either stopped or forwarded along the document line of travel 38. Furthermore, because selective driving and stopping of the first selective document transport means 20 is accomplished separately from selective driving and stopping of the second selective document transport means 24, pairs of documents 2 entering the separating and sequencing apparatus 18 may be separated and sequenced consistent with the account to which each document 2 belongs.

Figure 7:
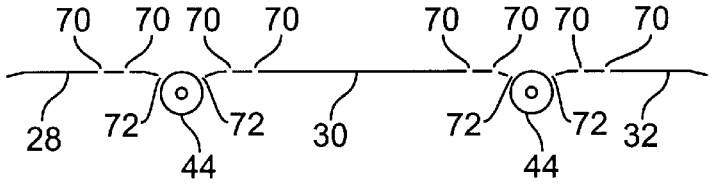
FIG. 7 depicts a substantially schematic cross-sectional representation of a separator and sequencing apparatus comprising an alternative document transport means.

As noted above, the first and second pair of rollers 22,26 are the preferred embodiments of said first and second selective document transport means 20,24, respectively. However, as related above, other embodiments are contemplated. For example, it is contemplated that a single roller may be employed as each first and second selective document transport means 20,24 as depicted in FIG. 7. In this embodiment, the lower roller assembly 44 employed for the first and second pair of rollers 22,26 is positioned in the same manner as when the first and second pair of rollers 22,26 are employed. However, no upper roller assembly 40 is employed in this embodiment. The downward force of the upper roller 40 required to ensure proper friction between the roller wheels 56 and the document 2 is replaced by a vacuum means (not depicted). Said vacuum means may be comprised of a series of vacuum ports 70 located in the guides 28,30,32 and adjacent to each respective selective document transport means 20,24. Alternatively a gap 72 between the first and second guides 28,30 and the second and third guide 30,32 may act as a single vacuum port 70. In either configuration, the vacuum means 68 holds documents 2 traveling over lower roller 44 onto lower roller 44 such that the proper friction is provided there between and allowing selective transport of each document 2 as provided below. It is also contemplated that the lower roller 44 of this alternative embodiment could be replaced by a continuous belt mounted around a plurality of driven pulleys (not depicted).

Figure 8:
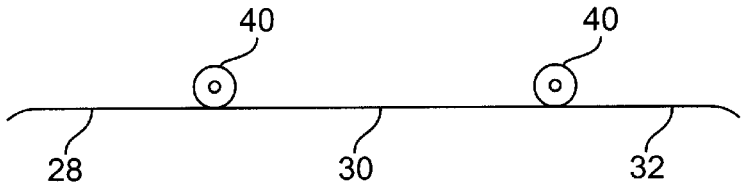
FIG. 8 depicts a substantially schematic cross-sectional representation of a separator and sequencing apparatus comprising an alternative document transport means.

Alternatively, it is contemplated that each of the first and second selective document transport means 20,24 may be comprise the upper roller assembly 40 employed for the first and second pair of rollers 22,26 as depicted in FIG. 8. In this embodiment, the first, second and third guides 28,30,32 may be comprised of a single guide means which runs under each of said first and second selective document transport means 20,24. The upper roller assembly 40 is positioned immediately above said single guide means such that a document 2 positioned between said upper roller assembly 40 and said single guide means may be selectively moved by rotation of said upper roller assembly 40 or stopped by stopping rotation of said upper roller assembly 40. It should be noted that the single roller assemblies 40,44 employed in the alternative embodiments of said first and second selective document transport means 20,24 may employ drive means 64, clutch means 62 and brake means 66 consistent with the preferred embodiment of said first and second selective document transport means 20,24.

While many functions may be performed with the apparatus 18 of the present invention, it has been found that the especially advantageous function of separating and sequencing pairs of documents 4,6 may be accomplished as described below. The separating and sequencing apparatus 18 is configured to initially treat each pair of documents 4,6 entering said separating and sequencing apparatus 18 in the same manner. The second document transport means 24 will encounter the first document 4 of the pair of documents and draw said first document 4 toward the first document transport means 20 and then encounter and draw the leading edge of the second document 6 which will be overlapping said first document 4 if having been supplied by the inverter 8. The first document transport means 20 will then grasp said first document 4. At the time the first document 4 of the pair of documents is within the control of said first document transport means 20 the trailing edge of said first document 4 is still overlapped by the leading edge of the second document 6. Further, the second document 6 is still within the grasp of the second document transport means 24. This position of the first and second documents 4,6 in the separator and sequencing apparatus 18 is depicted in FIG. 2.

Each pair of documents positioned in the separator and sequencing apparatus 18 in this configuration may present one of three possible situations. In the first situation, both documents 4,6 may be part of the account which is at that time being compiled, or awaiting to be compiled, in the accumulator 74. In this situation, any overlap of the documents 4,6 may be removed and both documents may to be forwarded into the accumulator 74. In the second situation, the first document 4 of the pair is part of an account which is at that time being compiled in the accumulator while the second document 6 is part of a separate account not being compiled in the accumulator 74. In this situation, the first document need be forwarded to the accumulator 74, while the second document is held in the separator and sequencing apparatus 18 until the accumulator 74 is empty and thereby ready for that second document. In the third situation, neither document 2 is part of the account presently in the accumulator. In this situation both documents 2 need be held in the separator and sequencing apparatus 18 until the accumulator is emptied of documents 2 and thereby ready for the documents 4,6 in the accumulator.

If the pair of documents entering the separating and sequencing apparatus 18 presents the above described first situation, both documents are required to be placed into the accumulator 74 before the account to be compiled therein may be completed. Therefore, both the first document 4 and the second document 6 are forwarded into the accumulator by engagement of the coupling means 60 to the drive means 64 via the clutch means 62.

Prior to forwarding the pair of documents into the accumulator 74, it may be desired to separate the first and second documents 4,6 such that they may enter the accumulator 74 individually. Separation of the first and second documents 4,6 will be required if the accumulator 74 is not configured to accept the second document 6 atop of the first document 4. However, if the accumulator 74 is configured to accept the second document 6 atop of the first document 4, separation of the first and second documents 4,6 may not be required for a pair of documents 4,6 belonging to the same account. In this case, the first and second documents 4,6 may both be forwarded into the accumulator 74 without separation. It should be understood, however, that a need to separate the documents 4,6 which belong to the same account could be eliminated by switching the type of accumulator 74 from a top stacker to a bottom stacker, or from a bottom stacker to a top stacker. A top stacker being an accumulator which places incoming documents atop of the stack of documents already in the accumulator 74 and a bottom stacker being an accumulator which places incoming documents at the bottom of the stack of documents already in the accumulator 74. A bottom stacker of this type was described in co-pending U.S. patent application Ser. No. 08/734,632 assigned to the assignee of the present invention.

When desired or required, separation of the first and second documents 4,6 is preferably accomplished in one of two manners. In the first preferred manner, the second pair of rollers 26 are either stopped or slowed while the rotation of the first pair of rollers 22 is left unabated as the first document 4 passes through the separator and sequencing apparatus 18. Slowing of the second pair of rollers 26 may either be accomplished by disengaging the coupling means 60 from the lower roller assembly 44 of the second pair of rollers 26 via the clutch means 62 and letting the rotation of the second pair of rollers 26 slow due to friction at the bearing means 48, or by employing the brake means 66 of the second pair of rollers 26 only enough to slow the second pair of rollers 26 but not enough to stop them. Stopping the second pair of rollers 26 may be accomplished by applying brake means 66 enough to halt rotation of the second pair of rollers 26.

The second preferred manner of separating the first and second documents 4,6 is to speed up the first pair of rollers 22. This may be accomplished when the first pair of rollers 22 and the second pair of rollers 26 have separate drive means 64. It should be noted at this point that any combination of slowing the second pair of rollers 26 and/or speeding up the first pair of rollers 22 is contemplated and lies within the scope of the present invention.

The difference in speed of rotation need be enough to remove the trailing edge of the first document 4 out from under the leading edge of the second document 6 prior to the leading edge of the second document 6 reaching the first pair of rollers 22. In this manner, the first pair of rollers 22 may eject the first document 4 of the pair of documents into the accumulator 74 and then separately eject the second document 6 into the accumulator 74.

It should be noted however that one of the advantages of the present invention separator and sequencing apparatus 18 lies in the ability to separate those pairs of documents 4,6 which need separating while simply advancing to the accumulator 74 those pairs of documents 4,6 which do not need separating. By advancing those documents which do not need separating, the present separating and sequencing apparatus may remove the delays caused by separating pairs of documents 4,6 not requiring separation.

As described above, the second situation which a pair of documents 4,6 in the separating and sequencing apparatus 18 may present comprises the first document 4 being part of the account which is currently required in the accumulator and the second document 6 being part of a separate account. Proper separating and sequencing in this situation can be handled in much the same manner as the first situation described above. The rotation of the second pair of rollers 26 may be slowed or stopped, the rotation of the first pair of rollers 22 may be sped up or many combinations thereof.

It should be noted that if the rotation of the second pair of rollers 26 is to be slowed to address the second situation, then they must be slowed a greater amount than required in the first situation presented above. Furthermore, if the rotation of the second pair of rollers 26 is to be stopped to address the second situation, then they may need be stopped longer than in the first situation presented above. Retarding progress of the second document 6 longer in the second situation than in the first situation allows for clearing of the accumulator 74 so that the second document 6 may be placed in its proper account.

Alternatively, the first pair of rollers 22 may accelerate the first document 4 to ensure that said first document 4 is placed into the accumulator 74 and said accumulator 74 is emptied prior to the second document reaching the accumulator 74. It should be noted at this point that any combination of slowing the second pair of rollers 26 and accelerating the first pair of rollers 22 is contemplated and lies within the scope of the present invention.

Regardless of how the separating and sequencing apparatus 18 handles the second situation, both the second pair of rollers 26 and the first pair of rollers 22 will rotate once the accumulator 74 is emptied of the previous account to which the first document 4 belonged. This rotation will advance the second document 6 into the empty accumulator 74 to begin accumulation of the new account to which the second document 6 belongs.

As described above, the third situation which the documents 4,6 in the separator and sequencing apparatus 18 may present is one in which neither of the documents 4,6 is part of the account which is presently in the accumulator 74. In this situation, the separating and sequencing apparatus 18 ensures that neither the first document 4 nor the second document 6 reaches the accumulator 74 until after the account therein is removed. Then the documents in the separator and sequencing apparatus 18 must be forwarded into the accumulator 74.

Holding back of the pair of documents may be accomplished by slowing the first and second pair of rollers 22,26 enough to allow the accumulator 74 to be cleared prior to the first document 4 reaching the accumulator 74. Alternatively, the first and second pair of rollers 22,26 may be stopped until such time as restarting rotation of said rollers would place the first and second documents 4,6 at the accumulator 74 when said accumulator 74 is ready to accept said documents 4,6. If the first and second pair of rollers 22,26 are merely slowed to retard the first and second documents 4,6, then once the accumulator 74 is emptied, the separating and sequencing apparatus removes the first and second documents 4,6 in a manner very similar to that of the first situation in which both of the first and second documents 4,6 belonged to the account in the accumulator 74. That is, the first document 4 and the second document 6 are separated, if desired, and deposited in the accumulator 74. If both the first and second documents 4,6 are brought to a complete stop in the separating and sequencing apparatus 18, then separation can occur by relative advancement of the first document 4 with respect to the second document 6.

It is preferred in each of the above situations that, when possible, the first and second documents 4,6 in the separating and sequencing apparatus 18 are not stopped at any position along the document line of travel 38 through the separating and sequencing apparatus 18. Stopping and starting of documents creates undesirable delays in operation of the apparatus 18. When documents are started and stopped, the overall processing time required for the documents 2 to proceed through the apparatus 2 is inherently increased. It is to be noted however that if the accumulator 74 requires a large amount of time to empty a complete account, then the time required to accomplish the starting and stopping of the first and second pair of rollers 4,6 may become irrelevant.

It should become apparent from the above descriptions that, in addition to separating and sequencing the documents 4,6, the separating and sequencing apparatus 18 acts as a buffer for the accumulator 74. In this regard, the separating and sequencing apparatus 18 allows the accumulator 74 to accumulate documents for a single account and then remove all documents 2 belonging to that account by delaying the continuous stream of documents 2 flowing into the separating and sequencing apparatus 18.

Figure 6:
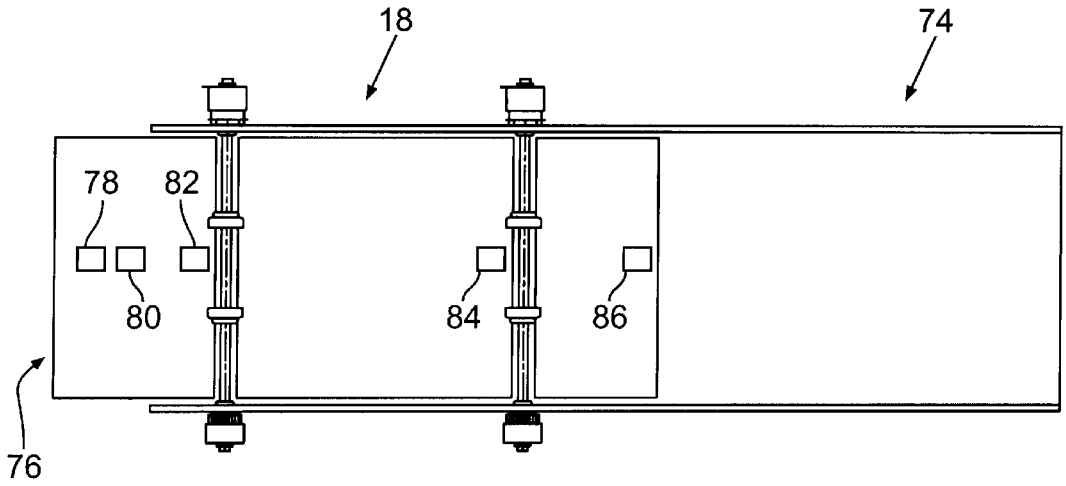
FIG. 6 depicts a substantially schematic representation of a top view of the present separator and sequencing apparatus with portions of the automated control system located thereon.

The engaging and disengaging of the clutch means 62, the drive means 64 and the brake means 66 required for separating and sequencing documents 2 is preferably, although not necessarily, achieved by selective control of the clutch means 62, the drive means 64, and the brake means 66 by the automated control system 76 comprising sensors as depicted in FIG. 6 and a computer (not depicted) operating on specialized software allowing said computer to read and analyze the sensor readings and operate said clutch means 62, said drive means 64 and said brake means 66 according to the present invention.

The automated control system 76 comprises a preliminary sensor 78 positioned between the second document transport means 24 and the inverter 8. The preliminary sensor 78 identifies the advancement of a document 2 toward the separating and sequencing apparatus 18 to begin rotation of the second document transport means 24 at the appropriate time to accept the advancing document 2.

Adjacent to the preliminary sensor 78 is positioned an identifier sensor 80 comprising a bar code reader, or other similar device, to read the account identification printed on each document 4,6. Each document 2 is printed with an identifying mark to facilitate computer identification of the account to which that document 2 belongs. This identifying mark may comprise a bar code or other known identifying mark to facilitate computer identification such as a OCR or a PDF file. As each document of a pair of documents 4,6 passes the identifier sensor 80, the automated control system 76 determines whether or not the first and second documents 4,6 belong to the same account. The automated control system 76 may also determine whether either the first or second document 4,6 belong to the account in the accumulator 74 at that time. Having computed such information, the automated control system 76 may identify in which of the three situations described above the first and second document 4,6 in the separating and sequencing apparatus 18 present. The automated control system 76 will then forward the first and second documents 4,6 at the appropriate time to accomplish proper account accumulation in the accumulator 74. The automated control system 76 will then clear the accumulator 74 and proceed to fill the accumulator 74 with the next account.

A second placement sensor 82 is preferably positioned adjacent to the second document transport means 24. The second placement sensor 82 determines and informs the automated control system 76 whether a document 2 is positioned in the second document transport means 24. Likewise, a first placement sensor 84 is positioned adjacent to the first document transport means 20 and said first placement sensor 84 determines and informs the automated control system 76 whether a document 2 is positioned in the first document transport means 20. Because the automated control system 76 is configured to operate the separating and sequencing apparatus 18 to facilitate proper account accumulation regardless of the situation which the documents 4,6 in the separating and sequencing apparatus 18 present, the first and second placement sensors 84,82 are not required for accumulating each account. Rather, the first and second placement sensors 84,82 inform the automated control system 76 when a mis-feed has occurred so that the problem may be rectified. The placements sensors 84,82 thereby prevent accumulation of inaccurate accounts. The placement sensors 84,82 may also allow the clearing of a mis-fed document 2 to prevent pile-up of subsequent documents entering the separating and sequencing apparatus 18. To ensure that each document leaving the first document transport means 20 properly arrives at the accumulator 74, at least one tracking sensor 86 is preferably positioned between the first document transport means 20 and the accumulator 74.

It is preferred that the sensors 78,80,82,84,86 are placed in the guides 28,30,32. However, it is contemplated that the sensors 78,80,82,84,86 could be placed in other locations so long as the sensors 78,80,82,84,86 may accomplish their purposed as discussed above.

It is important to note that while the separating and sequencing apparatus 18 of the present invention is described herein to accept documents from the inverter 8 described above, it is contemplated that the separating and sequencing apparatus could be used in other environments. For instance, the separating and sequencing apparatus 18 could be used to feed documents which are not overlapped. In this configuration, the advantages of sequencing two documents 4,6 would be employed without the need for using the separating aspects of the separating and sequencing apparatus 18.

The foregoing specification describes only the preferred embodiment of the invention as shown. Other embodiments besides those presented herein may be articulated as well. The terms and expressions therefore serve only to describe the invention by example only and not to limit the invention. It is expected that others will perceive differences which while differing from the foregoing, do not depart from the spirit and scope of the invention herein described and claimed.

I claim:

1. A hold station for separating and sequencing a first and second document of a series of pairs of documents and placing said documents in an account handler, wherein each of said first and second documents belong to at least one account, said hold station comprising:

a first end configured to be positioned adjacent said account handler;

a second end;

a first selective document transport means selectively mounted adjacent to said first end for selective advancement of documents from said second end toward said first end; and a second selective document transport means selectively mounted adjacent to said second end for selective advancement of documents toward said first end;

wherein said first and second selective document transport means are configured to advance each of said first and second documents to said account handler when said first and second documents both belong to the same account; and wherein said first selective document transport means is configured to advance said first document toward said first end, and said first and second selective document transport means are configured to temporarily withhold said second document from said account handler when said first document belongs to a different account than said second document.

2. The hold station of claim 1, further comprising an automated control system, said automated control system comprising means for identifying whether said first document and said second document of a pair of documents in said hold station belong to the same account.

3. The hold station of claim 2, further comprising:

at least one drive means connected to said first and second selective document transport means for supplying drive to each of said first and second selective document transport means;

a brake means fixed to each of said first and second selective document transport means for selective slowing or stopping of said first and second selective document transport means;

wherein said automated control system provides selective control of said first and second selective document transport means by selectively controlling said at least one drive means to advance at least one of said first and second documents toward said document handler and by selectively controlling said brake means to slow or stop advancement of at least one of said pair of documents toward said document handler.

4. The hold station of claim 3, wherein said first and second selective document transport means comprise a first and second pair of rollers, respectively, and each of said first and second pair of rollers comprise a lower roller and an upper roller positioned substantially vertically adjacent to said lower roller, said at least one drive means configured to facilitate selective rotation to each of said first and second pair of rollers, and said first and second rollers configured to impart selective movement to said first of second documents by selective rotation of said upper roller and said lower roller when any portion of said first or second documents is positioned between said upper roller and said lower roller.

5. A buffer station for separating and sequencing pairs of documents according to account association wherein each pair of documents comprises a first document belonging to a first account and a second document belonging to a second account, comprising:

a first end;

a second end;

a first selective document transport means selectively mounted adjacent to said first end for selective advancement of said first and second documents from said second end toward said first end;

a second selective document transport means selectively mounted adjacent to said second end for selective advancement of said first and second documents toward said first end; and an automated control system for controlling said selective advancement of documents;

wherein the automated control system comprises a means for determining whether the first account and the second account are the same account.

6. The buffer station of claim 5, wherein the first and second selective document transport means comprise a first pair of rollers and a second pair of rollers respectively, each of said first and second pair of rollers comprising a lower roller and an upper roller positioned vertically adjacent to said lower roller.

7. The buffer station of claim 6, further comprising:

an engagement means for transmitting rotational force from said lower roller to said upper roller in each of said first and second pairs of rollers;

a frame assembly first portion; and a frame assembly second portion, said frame assembly first and second portions defining a document path of travel therebetween to allow selective travel of said documents between the frame assembly first and second portions, each of said first and second pair of rollers selectively mounted to each of the frame assembly first and second portions to extend through the document path of travel.

8. The buffer station of claim 7, further comprising:

a guide selectively fixed between said frame assembly first portion and said frame assembly second portion and positioned between said second selective document transport means and said first selective document transport means;

at least one drive means for imparting selective rotation to the first and second pair of rollers to selectively advance documents along the document path of travel; and a brake means for imparting selective resistance to rotation to the first and second pair of rollers to selectively slow or stop advancement of documents along the document path of travel.

9. The buffer station of claim 8, wherein each of the upper and lower rollers of the first and second pair of rollers comprise:

a shaft selectively and rotatably mounted in each of said frame assembly first portion and said frame assembly second portion; and at least one roller wheel mounted on said shaft.

10. A method of separating and sequencing a first document and a second document by account association comprising:

providing a first end;

providing a second end;

providing a first selective document transport means located adjacent to said first end, for selective movement of documents;

providing a second selective document transport means adjacent to said second end, for selective movement of documents;

placing said first document into said second selective document transport means and activating said second document transport means to advance said first document to said first document transport means;

placing said second document into said second selective document transport means; and determining whether said first document and said second document belong to the same account.

11. The method of separating and sequencing of claim 10, further comprising:

providing an automated control system to determine whether said first document and said second document belong to the same account.

12. The method of separating and sequencing of claim 11, further comprising:

activating said first document transport means to advance said first document toward said first end; and determining whether said first document is contacting said second document.

13. The method of separating and sequencing of claim 11, further comprising:

activating said first document transport means to advance said first document out of said first document transport means; and activating said second document transport means to advance said second document to said first document transport means.

* * * * *